US012564222B2

(12) United States Patent
Emmett et al.

(10) Patent No.: US 12,564,222 B2
(45) Date of Patent: Mar. 3, 2026

(54) CARTRIDGE FOR USE IN AN AEROSOL-GENERATING SYSTEM

(71) Applicant: Philip Morris Products S.A., Neuchatel (CH)

(72) Inventors: Robert Emmett, Neuchatel (CH); Eva Saade Latorre, Colombier (CH)

(73) Assignee: Philip Morris Products S.A., Neuchatel (CH)

( * ) Notice: Subject to any disclaimer, the term of this patent is extended or adjusted under 35 U.S.C. 154(b) by 419 days.

(21) Appl. No.: 18/257,342

(22) PCT Filed: Dec. 13, 2021

(86) PCT No.: PCT/EP2021/085522
§ 371 (c)(1),
(2) Date: Jun. 14, 2023

(87) PCT Pub. No.: WO2022/136005
PCT Pub. Date: Jun. 30, 2022

(65) Prior Publication Data

US 2024/0023608 A1 Jan. 25, 2024

(30) Foreign Application Priority Data

Dec. 22, 2020 (EP) ..... 20216441

(51) Int. Cl.
*A24F 40/42* (2020.01)
*A24F 40/10* (2020.01)
(Continued)

(52) U.S. Cl.
CPC ..... *A24F 40/42* (2020.01); *A24F 40/10* (2020.01); *A24F 40/465* (2020.01);
(Continued)

(58) Field of Classification Search
None
See application file for complete search history.

(56) References Cited

U.S. PATENT DOCUMENTS

2015/0254669 A1 9/2015 Cadieux et al.
2015/0305408 A1 10/2015 Liu
(Continued)

FOREIGN PATENT DOCUMENTS

EP 3 099 188 A1 12/2016
EP 3 136 891 3/2017
(Continued)

OTHER PUBLICATIONS

JP_2019129759 English Translation (Year: 2019).*
(Continued)

*Primary Examiner* — Manley L Cummins, IV
(74) *Attorney, Agent, or Firm* — Oblon, McClelland, Maier & Neustadt, L.L.P.

(57) ABSTRACT

A cartridge for an aerosol-generating system is provided, the cartridge including: a reservoir configured for liquid aerosol-forming substrate; a heating element configured to heat the liquid aerosol-forming substrate from the reservoir; and a wall including a porous material, such that: a first space adjacent to the heating element and between the wall and the heating element forms a hot zone, a second space adjacent to the heating element forms a feed zone, the reservoir is in fluid communication with the feed zone and the hot zone, at least a portion of the wall is positioned between the hot zone and the reservoir, the wall is in contact with the hot zone and the reservoir, and a portion of the wall in contact with the feed zone is thinner than a portion of the wall in contact with the hot zone.

9 Claims, 5 Drawing Sheets

(51) Int. Cl.

| | |
|---|---|
| ***A24F 40/465*** | (2020.01) |
| ***A24F 40/485*** | (2020.01) |
| ***A24F 40/57*** | (2020.01) |
| *A24F 40/51* | (2020.01) |

(52) U.S. Cl.
CPC ..... *A24F 40/485* (2020.01); *A24F 40/57* (2020.01); *A24F 40/51* (2020.01)

(56) References Cited

U.S. PATENT DOCUMENTS

| | | | | |
|---|---|---|---|---|
| 2017/0127725 | A1 | 5/2017 | Buchberger et al. | |
| 2017/0188629 | A1 | 7/2017 | Dickens et al. | |
| 2017/0188630 | A1 | 7/2017 | Buchberger | |
| 2017/0333650 | A1* | 11/2017 | Buchberger | A61M 15/06 |
| 2017/0340014 | A1* | 11/2017 | Batista | A24F 40/485 |
| 2018/0184712 | A1 | 7/2018 | Fraser et al. | |
| 2018/0192700 | A1 | 7/2018 | Fraser et al. | |
| 2019/0142066 | A1 | 5/2019 | Gill et al. | |
| 2019/0223508 | A1* | 7/2019 | Otiaba | A24F 40/42 |
| 2020/0214361 | A1 | 7/2020 | Zhao et al. | |
| 2020/0268048 | A1 | 8/2020 | Buchberger et al. | |
| 2021/0315278 | A1 | 10/2021 | Fraser et al. | |
| 2022/0061397 | A1 | 3/2022 | Gill et al. | |

FOREIGN PATENT DOCUMENTS

| | | | |
|---|---|---|---|
| EP | 3 451 861 | A1 | 3/2019 |
| EP | 3 677 130 | A2 | 7/2020 |
| JP | 2019-129759 | A | 8/2019 |
| JP | 2019-521664 | A | 8/2019 |
| RU | 2 670 534 | C1 | 10/2018 |
| RU | 2 704 891 | C2 | 10/2019 |
| RU | 2 704 897 | C2 | 10/2019 |
| WO | WO 2017/028295 | A1 | 2/2017 |
| WO | WO 2017/161725 | A1 | 9/2017 |
| WO | WO 2022/136002 | A1 | 6/2022 |
| WO | WO 2022/136004 | A1 | 6/2022 |
| WO | WO 2022/136006 | A1 | 6/2022 |

OTHER PUBLICATIONS

Extended European Search Report issued Jun. 15, 2021 in European Patent Application No. 20216441.4, 8 pages.

International Preliminary Report on Patentability issued Apr. 13, 2023 in PCT/EP2021/085522, 12 pages.

Written Opinion issued Nov. 22, 2022 in PCT/EP2021/085522, 6 pages.

International Search Report & Written Opinion issued Apr. 7, 2022 in PCT/EP2021/085522 filed on Dec. 13, 2021, 10 pages.

Combined Russian Office Action and Search Report issued Jun. 2, 2025, in corresponding Russian Patent Application No. 2023118892/03(040678) (with English Translation and English Translation of Category of Cited Documents), 11 pages.

Notice of Allowance dated Dec. 15, 2025, issued in corresponding Japanese Patent Application No. 2023-536382 (with English translation).

* cited by examiner

SECTION A - A

CARTRIDGE FOR USE IN AN AEROSOL-GENERATING SYSTEM

The present disclosure relates to a cartridge for use in an aerosol-generating system. The present disclosure also relates to an aerosol-generating system comprising said cartridge.

In many known aerosol-generating systems, a liquid aerosol-forming substrate is heated and vaporised to form a vapour. The vapour cools and condenses to form an aerosol. In some aerosol-generating systems, such as electrically heated smoking systems, this aerosol is then inhaled by a user.

Typically, the liquid aerosol-forming substrate comprises several compounds which are vaporised when heated. These compounds may have different boiling points. For example, a liquid aerosol-forming substrate may comprise nicotine (with a boiling point of around 247 degrees Celsius at atmospheric pressure) and glycerol (with a boiling point of around 290 degrees Celsius at atmospheric pressure).

When a liquid aerosol-forming substrate comprising compounds having different boiling points is heated, compounds with lower boiling points may be vaporised before compounds with higher boiling points. Alternatively, or in addition, compounds with lower boiling points may be vaporised at a higher rate than compounds with higher boiling points.

This may be undesirable because interactions and combinations between different compounds may be limited. For example, a liquid aerosol-forming substrate may comprise a nicotine compound and an organic acid compound, these compounds having different boiling points. Both of these compounds may be vaporised. The nicotine in the liquid aerosol-forming substrate may form free base nicotine when it is vaporised. However, it may be desirable to generate an aerosol with nicotine salt rather than free base nicotine. In order to form this nicotine salt, the free base nicotine may be protonated by the vaporised organic acid. However, this protonation may be limited if the organic acid is not vaporised until after nicotine has vaporised, or is vaporised more slowly than is required to protonate a suitable proportion of the free base nicotine.

Further, vaporising some compounds of an aerosol-forming substrate more quickly than others may undesirably cause the properties of the aerosol generated to change over time, for example over the course of a puff on an aerosol-generating system. This may be because, towards the beginning of a puff, when a heating element is activated and rises in temperature, liquid aerosol-forming substrate close to the heating element may reach a first temperature at which a first compound with a lower boiling point is vaporised but a second compound with a higher boiling point is not vaporised. Then, later in the puff, liquid aerosol-forming substrate close to the heating element may reach a second temperature at which the second compound with the higher boiling point is vaporised. However, at this time, much of the first compound in the liquid aerosol-forming substrate close to the heating element may have already been vaporised. Thus, towards the start of a puff, the aerosol generated may comprise a larger proportion of the first compound and, later in the puff, the aerosol generated may comprise a larger proportion of the second compound.

Alternatively, or in addition, the properties of the aerosol generated may change over the course of several puffs. This may occur where compounds of the liquid aerosol-forming substrate are not vaporised at an appropriate rate. For example, a liquid aerosol-forming substrate may comprise X % by mass of a first compound and Y % by mass of a second compound. If the liquid aerosol-forming substrate is not vaporised to produce a vapour comprising a mass ratio of the first compound to the second compound of X to Y, then the composition of the liquid aerosol-forming substrate may change as vapour is generated. This may, in turn, lead to a change in the properties of the aerosol generated by the liquid aerosol-forming substrate.

It is an aim of the invention to control the vaporisation of various compounds of a liquid aerosol-forming substrate, where these compounds have different boiling points.

According to an aspect of the present disclosure, there is provided a cartridge for use in an aerosol-generating system. The cartridge may comprise a reservoir for liquid aerosol-forming substrate. The cartridge may comprise a heating element for heating liquid aerosol-forming substrate from the reservoir. The cartridge may comprise a wall. A first space may be adjacent to the heating element, and between the wall and the heating element. The first space may form a hot zone. A second space may be adjacent to the heating element. The second space may form a feed zone. The reservoir may be in fluid communication with the feed zone and the hot zone.

In use, the hot zone may be heated to a higher temperature than the feed zone. Alternatively, or in addition, in use, the hot zone may increase in temperature at a greater rate than the feed zone. Both the hot zone and the feed zone may be heated to temperatures sufficient to vaporise at least one compound in the liquid aerosol-forming substrate. Thus, in use, the cartridge may provide an area of higher temperature, and an area of lower temperature, in which liquid aerosol-forming substrate is vaporised.

Advantageously, the cartridge may improve control of the vaporisation of the different compounds of the liquid aerosol-forming substrate. The cartridge may result in liquid aerosol-forming substrate compounds with higher boiling points and lower boiling points being vaporised simultaneously at desirable rates. The cartridge may result in liquid aerosol-forming substrate compounds with higher boiling points and lower boiling points being vaporised in more preferable proportions. The cartridge may provide generation of an aerosol with a more desirable composition. The cartridge may provide more consistent generation of an aerosol with desirable properties.

In use, the hot zone may be heated to a first temperature. In use, the feed zone may be heated to a second temperature. The first temperature may greater than the second temperature. The first temperature may be at least 5, 10, 20 or 30 degrees Celsius greater than the second temperature.

Advantageously, a greater temperature difference between the hot zone and the feed zone may result in liquid aerosol-forming substrate compounds with higher boiling points and lower boiling points being vaporised at more preferable rates or in more preferable proportions or both at more preferable rates and in more preferable proportions.

The reservoir may be configured to store, or may store, at least 0.2, 0.5, or 1 millilitres of liquid aerosol-forming substrate. The reservoir may be configured to store, or may store, less than 2, 1.8, or 1.5 millilitres of liquid aerosol-forming substrate.

The wall may be positioned within the reservoir. The wall may form a boundary of the reservoir. The wall may be in contact with the reservoir. The wall may be in contact with the feed zone. The wall may be in contact with the hot zone. At least a portion of the wall may be positioned between the feed zone and the reservoir. At least a portion of the wall may be positioned between the hot zone and the reservoir. In use, liquid aerosol-forming substrate may be located on two opposing sides of the wall. In use, liquid aerosol-forming substrate may be in contact with two opposing sides of the wall.

The feed zone may be adjacent an opening in the wall. The feed zone may be adjacent an edge of the wall. The wall may be parallel to the heating element. The wall may have substantially the same shape as the heating element.

The wall may thermally insulate the heating element, or at least part of the heating element, from the reservoir. The wall may thermally insulate the hot zone from the reservoir. The wall may thermally insulate the feed zone from the reservoir. The wall, or a material forming the wall, may have a thermal conductivity which is at least 10, 20, 30, 40, 50, 60, or 70% less than a thermal conductivity of the liquid aerosol-forming substrate. The provision of the wall therefore at least partially gives rise to the creation of a hot zone and a relatively cooler feed zone.

Advantageously, this may improve the energy efficiency of the cartridge as less heat may be dissipated from the heating element, or from the hot zone, or from the feed zone, into the reservoir.

The hot zone may be more thermally insulated than the feed zone. Thus, if the feed zone and the hot zone were raised to identical temperatures and then left to cool, an initial rate of cooling of the feed zone may be greater than an initial rate of cooling of the hot zone.

Advantageously, this may help to increase or maintain a temperature difference between the feed zone and the hot zone in use.

A portion of the wall in contact with the feed zone may be thinner than a portion of the wall in contact with the hot zone. The wall may thermally insulate the feed zone from the reservoir to a lesser extent than the wall thermally insulates the hot zone from the reservoir.

Advantageously, this may help to increase or maintain a temperature difference between the feed zone and the hot zone in use.

In use, liquid aerosol-forming substrate may be transported from the reservoir to the feed zone. In use, liquid aerosol-forming substrate may be transported from the reservoir towards the heating element via the feed zone. In use, liquid aerosol-forming substrate may be transported from the feed zone to the hot zone. In use, liquid aerosol-forming substrate may be transported from the reservoir to the hot zone via the feed zone.

In use, liquid aerosol-forming substrate may be transported to the hot zone from the reservoir only via the feed zone. That is, the cartridge may configured such that liquid aerosol-forming substrate in the reservoir must be transported through the feed zone in order to reach the hot zone.

Advantageously, transporting liquid aerosol-forming substrate to the hot zone via the feed zone may mean that liquid aerosol-forming substrate reaching the hot zone has already been heated to some extent. This is because the feed zone may be adjacent the heating element. In this sense, liquid aerosol-forming substrate reaching the hot zone may be pre-heated.

The cartridge may comprise a passageway, for example a constricted passageway. The passageway may connect the reservoir to the feed zone. In use, liquid aerosol-forming substrate may be transported from the reservoir to the feed zone via the passageway. In use, liquid aerosol-forming substrate may be transported from the reservoir to the hot zone via the passageway and then the feed zone.

In use, liquid aerosol-forming substrate may be transported from the reservoir to the hot zone only via the passageway and then the feed zone. That is, the cartridge may configured such that liquid aerosol-forming substrate in the reservoir must be transported through the passageway and then the feed zone in order to reach the hot zone. The wall may form a boundary of the passageway.

Advantageously, the passageway, or the constricted passageway, may reduce heat dissipation from the heating element or the hot zone or the feed zone into the reservoir.

The cartridge may comprise an air inlet. The cartridge may comprise an air outlet. An air flow path may be defined between the air inlet and the air outlet. Air drawn from the air inlet to the air outlet may flow across, over, past, or through the heating element.

Advantageously, in use, this may increase the temperature of the air flow. Some users may prefer this. This may more accurately mimic the experience of smoking a conventional cigarette or cigar.

The heating element may at least partly circumscribe or encircle the air flow path. For example, the heating element may circumscribe at least 180, 225, 270, or 315 degrees of the air flow path. As an example, a cross-section of the heating element may form seven sides of a regular octagon. Air may flow through the air inlet, then through the centre of the octagon, then through the air outlet. As another example, the heating element may be prismatic, having a base which forms 300 degrees of a circle and a length extending in a perpendicular direction from the base. Air may flow through the air inlet, then through the centre of the base, then along the length of the heating element, then through the air outlet.

The heating element may circumscribe or encircle the air flow path. For example, a cross-section of the heating element may form a closed, two-dimensional shape such as a circle or a polygon. Air may flow through the air inlet, then through this closed two-dimensional shape formed by a cross-section of the heating element, then through the air outlet. As another example, the heating element may be a hollow cylinder in shape, and air may flow through the air inlet, then through the hollow cylinder, then through the air outlet.

Advantageously, the heating element at least partly circumscribing or encircling the air flow path may increase an amount of air flow in contact with the heating element. This may increase an average temperature of the air flow. This may also increase entrainment of vapour formed by the heating element in the air flow.

More than one air flow path may be defined in the cartridge. For example, the cartridge may include multiple air inlets, or multiple air outlets, or both multiple air inlets and multiple air outlets. Alternatively, or in addition, an air flow path from an air inlet may divide into two or more air flow paths. Alternatively, or in addition, two or more air flow paths in the cartridge may merge and exit through a single air outlet.

Advantageously, this may allow adjustment of an average temperature of an aerosol delivered to a user. This is because one or more air flow paths may be heated, and one or more other air flow paths may be not heated. In addition, this may allow adjustment of a resistance to draw for the cartridge. For example, adding an additional air inlet may allow a user to draw a greater flow of air through the cartridge for a given strength of inhalation on an air outlet.

The heating element, or portions thereof, may comprise an electrically resistive material. The cartridge may be configured such that, in use, an electric current is passed through the heating element or portions thereof. This may resistively heat said heating element or portions thereof. As such, the heating element, or portions thereof, may be configured to be resistively heated.

The heating element, or portions thereof, may comprise or be formed from any material with suitable electrical and mechanical properties, for example a suitable, electrically resistive material. Suitable materials include but are not limited to: semiconductors such as doped ceramics, electrically "conductive" ceramics (such as, for example, molybdenum disilicide), carbon, graphite, metals, metal alloys and composite materials made of a ceramic material and a metallic material. Such composite materials may comprise doped or undoped ceramics. Examples of suitable doped ceramics include doped silicon carbides. Examples of suitable metals include titanium, zirconium, tantalum and metals from the platinum group. Examples of suitable metal alloys include stainless steel, Constantan, nickel-, cobalt-, chromium-, aluminium-, titanium-, zirconium-, hafnium-, niobium-, molybdenum-, tantalum-, tungsten-, tin-, gallium-, manganese- and iron-containing alloys, and superalloys based on nickel, iron, cobalt, stainless steel, Timetal®, iron-aluminium based alloys and iron-manganese-aluminium based alloys. Timetal® is a registered trade mark of Titanium Metals Corporation, 1999 Broadway Suite 4300, Denver Colorado. In composite materials, the electrically resistive material may optionally be embedded in, encapsulated or coated with an insulating material or vice-versa, depending on the kinetics of energy transfer and the external physicochemical properties required. The heating element, or portions thereof, may comprise a metallic etched foil insulated between two layers of an inert material. In that case, the inert material may comprise Kapton®, all-polyimide or mica foil. Kapton® is a registered trade mark of E.I. du Pont de Nemours and Company, 1007 Market Street, Wilmington, Delaware 19898, United States of America.

The heating element may comprise a first portion and a second portion. The first portion may be configured to be heated to a higher temperature than the second portion.

Advantageously, this may allow creation of more areas of higher temperature and more areas of lower temperature. This may allow more preferable rates of vaporisation of compounds of the liquid aerosol-forming substrate with higher and lower boiling points. Alternatively, or in addition, this may allow a greater temperature difference between the hot zone and the feed zone. This may be the case where the first portion is located closer to the hot zone than the feed zone, or the second portion is located closer to the feed zone than the hot zone, or both the first portion is located closer to the hot zone than the feed zone and the second portion is located closer to the feed zone than the hot zone.

The heating element, or the first portion, or the second portion, or both the first portion and the second portion of the heating element may be configured to be heated to at least 50, 100, 150, 200, 250, 300, 350, or 400 degrees Celsius. In use, the heating element, or the first portion, or the second portion, or both the first portion and the second portion of the heating element may be heated to at least 50, 100, 150, 200, 250, 300, 350, or 400 degrees Celsius.

The first portion may have one or more of a first electrical resistance, a first electrical resistivity, and a first average cross-sectional area. The second portion may have one or more of a second electrical resistance, a second electrical resistivity, and a second average cross-sectional area. The first electrical resistance may be greater than the second electrical resistance. The first electrical resistivity may be greater than the second electrical resistivity. The first average cross-sectional area may be less than the second average cross-sectional area.

Advantageously, this may allow the first portion to be heated to a higher temperature than the second portion.

The second portion may comprise a section arranged to contact itself. For example, the section may be folded or curved such that the section contacts itself.

Advantageously, where the second portion is resistively heated, this may reduce an electrical resistance of the second portion. This may reduce the temperature to which the second portion is heated.

The heating element, or portions thereof, may comprise a susceptor material. The cartridge may be configured to be used in an aerosol-generating system comprising an inductor, such as an induction coil. The inductor may be located in an aerosol-generating device having a power supply. The device may be configured to engage with the cartridge. Alternatively, the inductor may be located in the cartridge. The cartridge may be configured to engage with an aerosol-generating device having a power supply.

The power supply may be configured to pass an alternating current through the inductor in the cartridge, or the inductor in the device, such that the inductor generates a fluctuating or oscillating electromagnetic field.

The alternating current may have any suitable frequency. The alternating current may be a high frequency alternating current. The alternating current may have a frequency between 100 kilohertz (kHz) and 30 megahertz (MHz). Where the inductor is a tubular inductor coil, the alternating current may have a frequency of between 500 kilohertz (kHz) and 30 megahertz (MHz). Where the inductor is a flat inductor coil, the alternating current may have a frequency of between 100 kilohertz (kHz), and 1 megahertz (MHz).

The heating element may be located within, or otherwise subjected to, the electromagnetic field generated by the inductor. This may generate eddy currents and hysteresis losses in the susceptor material. This may cause the susceptor material to heat up. Thus, the power supply and the inductor may be configured to inductively heat the heating element or portions thereof.

The susceptor material may be, or may comprise, any material that can be inductively heated to a temperature sufficient to generate an aerosol from the aerosol-forming substrate. Preferred susceptor materials may be heated to a temperature in excess of 50, 100, 150, 200, 250, 300, 350, or 400 degrees Celsius. Preferred susceptor materials may comprise a metal or carbon or both a metal and carbon. A preferred susceptor material may comprise a ferromagnetic material, for example ferritic iron, or a ferromagnetic steel or stainless steel. A suitable susceptor element may be, or comprise, one or more of graphite, molybdenum, silicon carbide, stainless steels, niobium, and aluminium. Preferred susceptor materials may comprise, or be formed from, 400 series stainless steels, for example grade 410, or grade 420, or grade 430 stainless steel. Different materials will dissipate different amounts of energy when positioned within electromagnetic fields having similar values of frequency and field strength. Thus, parameters of the susceptor material such as material type and size may be altered to provide a desired power dissipation within a known electromagnetic field.

Advantageously, in an aerosol-generating system which uses inductive heating, no electrical contacts need be formed between the heating element and the aerosol-generating device. In addition, the heating element may not need to be electrically joined to other components. This may eliminate the need for solder or other bonding elements. A cartridge incorporating a heating element which is configured to be inductively heated may allow production of a cartridge that is simple, inexpensive and robust. Cartridges are typically disposable articles produced in much larger numbers that the aerosol-generating devices with which they operate. Accordingly, reducing the cost of cartridges can lead to significant cost savings for manufacturers. In addition, inductive heating may provide improved energy conversion compared to resistive heating. This is because inductive heating may not have power losses associated with electrical resistance in connections between a resistive heating element and a power supply.

The first portion may comprise one or more of a curve, a fold, a corrugation and an undulation. This may increase the volume, or surface area, of the first portion present in a given volume. Advantageously, this may allow the first portion to transfer more heat to the given volume.

A curve may refer to a gradual change in direction. Thus, a curve may form an arc, or a "C" shape.

A fold may refer to a step change in direction. Thus, a fold may form two sides of a polygon, or a "V" shape.

An undulation may comprise multiple curves. For example, an undulation may refer to a gradual change in direction in a first direction, followed by a gradual change in direction in another, for example opposite, direction. Thus, an undulation may form a sinusoidal wave, or an "S" shape.

A corrugation may comprise multiple folds. For example, a corrugation may refer to a step change in direction, followed by another step change in direction. Thus, a corrugation may form three sides of a rectangle, or an "M" shape, or an "N" shape.

Advantageously, one or more of curves, undulations, folds, and corrugations may allow the first portion to heat a given volume to a higher temperature. For example, the first portion may be comprise a tightly curved "S" shape. The region around this tightly curved "S" shape of the first portion may be heated to a higher temperature than if the tightly curved "S" shape were not present.

A cross-section, or cross-sectional area, of the heating element may vary. For example an average cross-sectional area of the first portion may be at least 5, 10, 20, 30, or 50% less than an average cross-sectional area of the second portion.

Advantageously, if the heating element is configured to be resistively heated, this may result in the first portion having a higher electrical resistance and being heated to a higher temperature than the second portion.

The first portion may be located closer to the hot zone than the second portion. The second portion may be located closer to the feed zone than the first portion. The first portion may be adjacent to, or in contact with, or both adjacent to and in contact with the hot zone. The first portion may be not in contact with the feed zone. The second portion may adjacent to, or in contact with, or both adjacent to and in contact with the feed zone. The first portion may be not in contact with the hot zone.

Advantageously, this may allow the first portion to heat the hot zone more than the second portion heats the hot zone. Alternatively, or in addition, this may mean that more heat from the first portion is transferred to the hot zone than to the feed zone. This may help to increase, or maintain, a temperature difference between the hot zone and the feed zone in use.

The cartridge may comprise a support for the heating element. The heating element may contact the support. The second portion of the heating element may contact the support. The first portion of the heating element may not contact the support. The heating element may be fixed to, or at least partly secured in place by, the support.

Advantageously, the support may secure the heating element in position.

The wall may form the support.

Advantageously, the wall forming the support may eliminate the need for another structure, separate to the wall, to form the support. This may allow the manufacture of a more inexpensive cartridge.

In use, liquid aerosol-forming substrate in the feed zone may be vaporised. In use, liquid aerosol-forming substrate in the hot zone may be vaporised. In use, liquid aerosol-forming substrate in the feed zone and liquid aerosol-forming substrate in the hot zone may be vaporised simultaneously.

Advantageously, this may increase a rate of vaporisation of liquid aerosol-forming substrate during use of the cartridge. Further, an average composition of liquid aerosol-forming substrate vaporised from the feed zone may be different to an average composition of liquid aerosol-forming substrate vaporised from the hot zone. The liquid aerosol-forming substrate vaporised from the feed zone may comprise a larger proportion of a compound with a relatively low boiling point than liquid aerosol-forming substrate vaporised from the hot zone. The liquid aerosol-forming substrate vaporised from the hot zone may comprise a larger proportion of a compound with a relatively high boiling point than liquid aerosol-forming substrate vaporised from the feed zone. Thus, liquid aerosol-forming substrate compounds with higher boiling points and lower boiling points may be vaporised simultaneously at desirable rates and in more preferable proportions. An aerosol with a more desirable composition may be generated. An aerosol with desirable properties may be generated more consistently.

The feed zone may be located between the wall and the heating element.

A minimum distance between the wall and the heating element through the hot zone may be less than a minimum distance between the wall and the heating element through the feed zone. Alternatively, or in addition, a maximum distance between the wall and the heating element through the hot zone may be less than a maximum distance between the wall and the heating element through the feed zone. Alternatively, or in addition, an average distance between the wall and the heating element through the hot zone may be less than an average distance between the wall and the heating element through the feed zone.

Advantageously, this may increase a temperature difference between the hot zone and the feed zone in use. Specifically, this may result in greater heating of the hot zone.

The hot zone may be smaller than the feed zone. The hot zone may comprise a smaller volume of liquid aerosol-forming substrate than the feed zone during use of the cartridge.

Advantageously, this may increase a temperature difference between the hot zone and the feed zone in use. Specifically, this may result in greater heating of the hot zone.

The heating element may be perforated. The heating element may be a mesh heating element. The heating element may comprise a mesh. The first portion, or the second portion, or both the first portion and the second portion may comprise perforations, or a mesh.

Advantageously, a mesh heating element, or a heating element comprising a mesh, may provide a large surface area in contact with the liquid aerosol-forming substrate. This large surface area may provide efficient vaporisation of the liquid aerosol-forming substrate.

The wall may be configured to hold liquid aerosol-forming substrate. The wall may comprise, or may be, a material soaked with, or a material configured to be soaked with, liquid aerosol-forming substrate. The wall may have a fibrous or spongy structure. The wall may comprise a porous material. The wall may comprise a capillary material. The wall may comprise a bundle of capillaries. For example, the wall may comprise one or more of fibres, threads, and fine bore tubes.

The wall may comprise sponge-like or foam-like material. The structure of the wall may form a plurality of small bores or tubes, through which the liquid can be transported by capillary action.

The wall may comprise any suitable material or combination of materials. Suitable materials include but are not limited to: a sponge or foam material, ceramic- or graphite-based materials in the form of fibres or sintered powders, foamed metal or plastics material, a fibrous material, for example made of spun or extruded fibres, such as cellulose acetate, polyester, or bonded polyolefin, polyethylene, terylene or polypropylene fibres, nylon fibres or ceramic. The wall may comprise a ceramic material. The wall may have any suitable capillarity and porosity so as to be used with different liquid aerosol-forming substrates having different physical properties.

Advantageously, these materials may allow liquid aerosol-forming substrate to pass through the wall. This may prevent areas of the heating element, or the hot zone, or the feed zone, from becoming dry.

In use, liquid aerosol-forming substrate may be able to pass from through the wall. In use, liquid aerosol-forming substrate may be able to pass from the reservoir, through the wall and towards the heating element. In use, liquid aerosol-forming substrate may be able to pass from the reservoir, through the wall and towards, or into, the hot zone. In use, liquid aerosol-forming substrate may be able to pass from the reservoir, through the wall and towards, or into, the feed zone.

Advantageously, liquid aerosol-forming substrate being able to pass through the wall may prevent the hot zone, the feed zone, or a portion of the heating element from becoming dry as liquid aerosol-forming substrate is vaporised. This may allow more consistent vaporisation of liquid aerosol-forming substrate.

The wall may be in fluid communication with the reservoir.

Advantageously, the wall being in fluid communication with the reservoir may allow liquid aerosol-forming substrate removed from the wall to be replenished quickly and automatically by liquid aerosol-forming substrate from the reservoir.

A thermal conductivity of the wall may be less than a thermal conductivity of the liquid aerosol-forming substrate.

Advantageously, this may allow the wall to effectively thermally insulate the heating element, or the feed zone, or the hot zone from the reservoir.

The wall may be not porous. Liquid aerosol-forming substrate may not be able to pass through the wall. The wall may comprise, or be formed from, a polymeric material. Advantageously, non-porous materials may prevent liquid aerosol-forming substrate from passing through the wall. Depending on the arrangement of the wall, this may mean that liquid aerosol-forming substrate must pass through the feed zone in order to reach the hot zone. Thus, liquid aerosol-forming substrate reaching the hot zone may be pre-heated.

A shortest distance between the hot zone and the heating element may be equal to a shortest distance between the feed zone and the heating element. The hot zone may be in contact with the heating element. The feed zone may be in contact with the heating element.

The cartridge may comprise a second hot zone. The second hot zone may be formed by a third space adjacent to the heating element. The third space may be between the wall and the heating element. The second hot zone may be in contact with the heating element. The second hot zone may be in contact with the wall.

Features described above in relation to the first space or hot zone may be applicable to the third space or the second hot zone, respectively.

In use, liquid aerosol-forming substrate may be transported from the feed zone to the second hot zone. Thus, liquid aerosol-forming substrate may be transported from the feed zone to both the hot zone and the second hot zone. In use, liquid aerosol-forming substrate may be transported from the reservoir to the second hot zone via the feed zone. In use, liquid aerosol-forming substrate may be transported to the second hot zone from the reservoir only via the feed zone. That is, the cartridge may configured such that liquid aerosol-forming substrate in the reservoir must be transported through the feed zone in order to reach the second hot zone.

Advantageously, transporting liquid aerosol-forming substrate to the second hot zone via the feed zone may mean that liquid aerosol-forming substrate reaching the second hot zone has already been heated. This is because the feed zone may be adjacent the heating element. In this sense, liquid aerosol-forming substrate reaching the second hot zone may be pre-heated.

The cartridge may comprise a second feed zone. The second feed zone may be formed by a fourth space adjacent to the heating element.

Features described above in relation to the second space or the feed zone may be applicable to the fourth space or the second feed zone, respectively.

Advantageously, a second hot zone and second feed zone may increase the numbers of areas of higher temperature and areas of lower temperature in use. This may result in liquid aerosol-forming substrate compounds with higher boiling points and lower boiling points being vaporised simultaneously at desirable rates. This may result in liquid aerosol-forming substrate compounds with higher boiling points and lower boiling points being vaporised in more preferable proportions. This may provide generation of an aerosol with a more desirable composition. This may provide more consistent generation of an aerosol with desirable properties.

In use, liquid aerosol-forming substrate may be transported from the second feed zone to the second hot zone. In use, liquid aerosol-forming substrate may be transported from the reservoir to the second hot zone via the second feed zone. In use, liquid aerosol-forming substrate may be transported to the second hot zone from the reservoir only via the second feed zone. That is, the cartridge may configured such that liquid aerosol-forming substrate in the reservoir must be transported through the second feed zone in order to reach the second hot zone.

Advantageously, transporting liquid aerosol-forming substrate to the second hot zone via the second feed zone may mean that liquid aerosol-forming substrate reaching the second hot zone has already been heated. This is because the second feed zone may be adjacent the heating element. In this sense, liquid aerosol-forming substrate reaching the second hot zone may be pre-heated.

The reservoir may be in fluid communication with the second feed zone and the second hot zone.

The passageway may connect the reservoir to the second feed zone. In use, liquid aerosol-forming substrate may be transported from the reservoir to the feed zone via the passageway. In use, liquid aerosol-forming substrate may be transported from the reservoir to the second hot zone via the passageway and then the feed zone.

The cartridge may comprise a second passageway, for example a second constricted passageway. The second passageway may connect the reservoir to the second feed zone.

In use, liquid aerosol-forming substrate may be transported from the reservoir to the feed zone via the second passageway. In use, liquid aerosol-forming substrate may be transported from the reservoir to the second hot zone via the second passageway and then the feed zone. The wall, or a second wall, may form a boundary of the second passageway. Advantageously, the second passageway, or the second constricted passageway, may reduce heat dissipation from the heating element or the second hot zone or the second feed zone into the reservoir.

The cartridge may comprise first and second electrical contacts electrically connected to the heating element. The electrical contacts may comprise one or more of tin, silver, gold, copper, aluminium, steel such as stainless steel, phosphor bronze, tin alloyed with antimony, tin alloyed with zirconium, tin alloyed with bismuth, or tin alloyed with other components improving resistance to organic acids.

The electrical contacts may be configured to form an electrical connection with corresponding electrical contacts on an aerosol-generating device when the cartridge is engaged with the aerosol-generating device.

According to a second aspect of the present disclosure, there is provided an aerosol-generating system. The system may comprise a cartridge. The cartridge may be the cartridge according to the present disclosure. The system may comprise an aerosol-generating device. The aerosol-generating device may comprise a power supply.

The cartridge may be configured to engage with, and disengage from, the aerosol-generating device. The power supply may be configured to supply power to the heating element. The power supply may be configured to supply power to the heating element only when the cartridge is engaged with the aerosol-generating device.

The aerosol-generating device may comprise a controller. The controller may be configured to control supply of power from the power supply. Thus, the controller may control heating of the heating element.

The power supply may be configured to supply power to the heating element to resistively heat the heating element. The power supply may be configured to supply power to the heating element to inductively heat the heating element.

The aerosol-generating device may be configured to engage to, and disengage from, the cartridge via a snap-fit connection, corresponding screw threads or any other suitable means. The aerosol-generating device may be configured to receive at least a portion of the cartridge. For example, the aerosol-generating device may comprise a chamber configured to receive at least a portion of the cartridge.

The aerosol-generating device may comprise an air inlet. The aerosol-generating device may comprise an air outlet. When the aerosol-generating device is engaged with the cartridge, the air outlet of the aerosol-generating device may be in fluid communication with the air inlet of the cartridge.

The power supply may be electrically connected to first and second electrical contacts of the device. These first and second electrical contacts may be configured to form an electrical connection with corresponding first and second electrical contacts on the cartridge when the cartridge is engaged with the device. These corresponding first and second electrical contacts on the cartridge may be electrically connected to the heating element. Thus, the power supply may be configured to supply power to the heating element by passing a current through the heating element.

The cartridge or the aerosol-generating device may comprise an inductor, for example an induction coil. The heating element may be, or may comprise, a susceptor material.

The power supply may be configured to pass a current, such as a high frequency alternating current, through the inductor such that the inductor generates a fluctuating or oscillating electromagnetic field. This, in turn, may generate eddy currents and hysteresis losses in the susceptor material. This may cause the susceptor material to heat up. Thus, the power supply, using the inductor, may be configured to inductively heat the heating element.

Suitable susceptor materials include those mentioned earlier with reference to the cartridge according to the present disclosure.

The inductor may be an induction coil. The inductor may be located in the cartridge. The inductor may be disposed around the heating element, or around part of the heating element. For example, the inductor may be an induction coil and may spiral around the heating element, or around part of the heating element.

The inductor may be electrically connected to electrical contacts on the cartridge. When the cartridge is engaged with an aerosol-generating device, these electrical contacts may be electrically connected to corresponding electrical contacts on the device which are electrically connected to a power supply in the device. When the cartridge is engaged with the device, the power supply of the device may be configured to pass a current through the inductor to generate a fluctuating electromagnetic field and thereby heat the susceptor material of the heating element.

The inductor, such as an induction coil, may be located in the aerosol-generating device. The inductor may be electrically connected to a power supply of the aerosol-generating device. The aerosol-generating device may be configured to engage with the cartridge. For example, the device may comprise a chamber for receiving at least a portion of the cartridge. The induction coil may be disposed around at least part of this chamber. For example, the induction coil may spiral around at least part of the chamber. As such, when the cartridge is engaged with the device, the induction coil may be disposed around, or spiral around, the heating element or part of the heating element. When at least a portion of the cartridge is received within the chamber of the device, the power supply of the device may be configured to pass a current through the inductor to generate a fluctuating or oscillating electromagnetic field and thereby heat the susceptor material of the heating element.

As mentioned above, inductive heating may advantageously allow production of a cartridge that is simple, inexpensive and robust. In addition, inductive heating may provide improved energy conversion compared to resistive heating.

The aerosol-generating system may be a smoking system, for example an electrically operated smoking system. The aerosol-generating system may be for recreational use. In use, the aerosol-generating system may be suitable for delivering, or configured to deliver, nicotine to a user.

The aerosol-generating system may be portable. The aerosol-generating system may have a size comparable to a conventional cigar or cigarette. The smoking system may have a total length between 30 millimetres and 200 millimetres. The smoking system may have an external diameter between 5 millimetres and 30 millimetres.

As used herein, the term "aerosol" refers to a dispersion of solid particles, or liquid droplets, or a combination of solid particles and liquid droplets, in a gas. The aerosol may be visible or invisible. The aerosol may include vapours of substances that are ordinarily liquid or solid at room temperature as well as solid particles, or liquid droplets, or a combination of solid particles and liquid droplets.

As used herein, the term "aerosol-forming substrate" refers to a substrate capable of releasing volatile compounds that can form an aerosol. The volatile compounds may be released by heating or combusting the aerosol-forming substrate.

The aerosol-forming substrate may comprise a plurality of compounds. The compounds may have different boiling points. For example, the aerosol-forming substrate may comprise a first compound with a first boiling point at atmospheric pressure and a second compound with a second boiling point at atmospheric pressure, the first boiling point being greater than the second boiling point.

The aerosol-forming substrate may comprise an aerosol former. As used herein, the term "aerosol-former" refers to any suitable compound or mixture of compounds that, in use, facilitates formation of an aerosol, for example a stable aerosol that is substantially resistant to thermal degradation at the temperature of operation of the system. Suitable aerosol-formers are well known in the art and include, but are not limited to: polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate.

The aerosol-forming substrate may comprise nicotine. The aerosol-forming substrate may comprise water. The aerosol-forming substrate may comprise glycerol, also referred to as glycerine, which has a higher boiling point than nicotine. The aerosol-forming substrate may comprise plant-based material. The aerosol-forming substrate may comprise homogenised plant-based material. The aerosol-forming substrate may comprise tobacco.

The aerosol-forming substrate may comprise a tobacco-containing material. The tobacco-containing material may contain volatile tobacco flavour compounds. These compounds may be released from the aerosol-forming substrate upon heating. The aerosol-forming substrate may comprise homogenised tobacco material. The aerosol-forming substrate may comprise other additives and ingredients, such as flavourants.

As used herein, the term "liquid aerosol-forming substrate" is used to refer to an aerosol-forming substrate in condensed form. Thus, the "liquid aerosol-forming substrate" may be, or may comprise, one or more of a liquid, gel, or paste. If the liquid aerosol-forming substrate is, or comprises, a gel or paste, the gel or paste may liquidise upon heating. For example, the gel or paste may liquidise upon heating to a temperature of less than 50, 75, 100, 150, or 200 degrees Celsius.

There terms hot zone and feed zone may be used interchangeably with first space and second space, respectively.

As used herein, the term "reservoir", unless explicitly stated otherwise, may be used to refer to a reservoir for storing liquid aerosol-forming substrate or a reservoir of liquid aerosol-forming substrate. The term "reservoir", unless explicitly stated otherwise, may be used to refer to a reservoir for storing a free-flowing liquid aerosol forming substrate, or to a reservoir of free-flowing liquid aerosol-forming substrate.

The invention is defined in the claims. However, below there is provided a non-exhaustive list of non-limiting examples. Any one or more of the features of these examples may be combined with any one or more features of another example, embodiment, or aspect described herein.

Example Ex1. A cartridge for use in an aerosol-generating system, the cartridge comprising:

a reservoir of liquid aerosol-forming substrate;

a heating element for heating liquid aerosol-forming substrate from the reservoir; and a wall, wherein a first space adjacent to the heating element and between the wall and the heating element forms a hot zone, and a second space adjacent to the heating element forms a feed zone, and the reservoir is in fluid communication with the feed zone and the hot zone.

Example Ex2. A cartridge according to Ex1, wherein, in use, the hot zone is heated to a first temperature and the feed zone is heated to a second temperature, and the first temperature is greater than the second temperature.

Example Ex3. A cartridge according to Ex2, wherein the first temperature is at least degrees Celsius greater than the second temperature.

Example Ex4. A cartridge according to any preceding Example, wherein the wall is positioned within the reservoir.

Example Ex5. A cartridge according to any preceding Example, wherein the wall thermally insulates the hot zone from the reservoir.

Example Ex6. A cartridge according to any preceding Example, wherein the wall thermally insulates the feed zone from the reservoir to a lesser extent than the wall thermally insulates the hot zone from the reservoir.

Example Ex7. A cartridge according to any preceding Example, wherein, in use, liquid aerosol-forming substrate is transported from the reservoir towards the heating element via the feed zone.

Example Ex8. A cartridge according to any preceding Example, wherein, in use, liquid aerosol-forming substrate is transported from the reservoir to the hot zone via the feed zone.

Example Ex9. A cartridge according to any preceding Example, the cartridge comprising an air inlet and an air outlet, an air flow path being defined between the air inlet and the air outlet.

Example Ex10. A cartridge according to Ex9, wherein air drawn from the air inlet to the air outlet flows across, past, or through the heating element.

Example Ex11. A cartridge according to Ex9 or Ex10, wherein the heating element surrounds a portion of the air flow path.

Example Ex12. A cartridge according to any preceding Example, wherein the heating element comprises a first portion and a second portion.

Example Ex13. A cartridge according to Ex12, wherein the first portion is configured to be heated to a higher temperature than the second portion.

Example Ex14. A cartridge according to Ex12 or Ex13, wherein the first portion has a first electrical resistance and the second portion has a second electrical resistance, the first electrical resistance being greater than the second electrical resistance.

Example Ex15. A cartridge according to any of Examples Ex12 to Ex14, wherein the second portion comprises a folded section in contact with itself.

Example Ex16. A cartridge according to any of Examples Ex12 to Ex15, wherein the first portion comprises one or more of a curve, a fold, a corrugation and an undulation.

Example Ex17. A cartridge according to any of Examples Ex12 to Ex16, wherein the first portion is located closer to the hot zone than the second portion.

Example Ex18. A cartridge according to any of Examples Ex12 to Ex17, wherein the second portion is located closer to the feed zone than the first portion.

Example Ex19. A cartridge according to any preceding Example, comprising a support for the heating element.

Example Ex20. A cartridge according to Ex19, wherein the wall forms the support.

Example Ex21. A cartridge according to any of Examples Ex12 to Ex18, wherein the wall forms a support for the heating element and the second portion of the heating element is in contact with the wall.

Example Ex22. A cartridge according to any preceding Example, wherein, in use, liquid aerosol-forming substrate in the feed zone is vaporised and liquid aerosol-forming substrate in the hot zone is vaporised.

Example Ex23. A cartridge according to any preceding Example, wherein the second space is between the wall and the heating element.

Example Ex24. A cartridge according to any preceding Example, wherein a shortest distance between the wall and the heater through the hot zone is less than a shortest distance between the wall and the heater through the feed zone.

Example Ex25. A cartridge according to any preceding Example, wherein the heating element is a mesh heating element.

Example Ex26. A cartridge according to any preceding Example, wherein the wall is configured hold liquid aerosol-forming substrate.

Example Ex27. A cartridge according to any preceding Example, wherein, in use, liquid aerosol-forming substrate can pass from the reservoir, through the wall and towards the heating element.

Example Ex28. A cartridge according to any preceding Example, wherein, in use, liquid aerosol-forming substrate can pass from the reservoir, through the wall and towards the hot zone.

Example Ex29. A cartridge according to any preceding Example, wherein the wall comprises a porous material.

Example Ex30. A cartridge according to any preceding Example, wherein the wall comprises a capillary retention material.

Example Ex31. A cartridge according to any preceding Example, wherein a thermal conductivity of the wall is less than a thermal conductivity of the liquid aerosol-forming substrate.

Example Ex32. A cartridge according to any preceding Example, wherein a shortest distance between the hot zone and the heating element is equal to a shortest distance between the feed zone and the heating element.

Example Ex33. An aerosol-generating system comprising a cartridge according to any preceding Example.

Example Ex34: An aerosol-generating system according to Ex33, the system comprising an aerosol-generating device.

Example Ex35: An aerosol-generating system according to Ex34, wherein the cartridge is configured to engage with, and disengage from, the aerosol-generating device.

Example Ex36: An aerosol-generating system according to any of Examples Ex33, Ex34, or Ex45, wherein the aerosol-generating system comprises a power supply configured to supply power to the heating element to heat the heating element.

Example Ex37: An aerosol-generating system according to Ex34 or Ex35, wherein the aerosol-generating device comprises a power supply configured to supply power to the heating element to heat the heating element.

Example Ex38: An aerosol-generating system according to Ex36 or Ex37, wherein the power supply is configured to supply power to the heating element to resistively heat the heating element.

Example Ex39: An aerosol-generating system according to Ex36 or Ex37, wherein the power supply is configured to supply power to the heating element to inductively heat the heating element.

Example Ex40: An aerosol-generating system according to any of Examples Ex33 to Ex39, wherein the aerosol-generating system has a total length of between 30 millimetres and 200 millimetres.

Example Ex41: An aerosol-generating system according to any of Examples Ex33 to Ex40, wherein the aerosol-generating system has an external diameter of between 5 millimetres and 30 millimetres.

Example Ex42: An aerosol-generating system according to any of Examples Ex33 to Ex41, wherein the aerosol-generating system is portable.

Example Ex43: An aerosol-generating system according to any of Examples Ex33 to Ex42, wherein the aerosol-generating system is a smoking system.

Examples will now be further described with reference to the figures in which.

Figure 1:
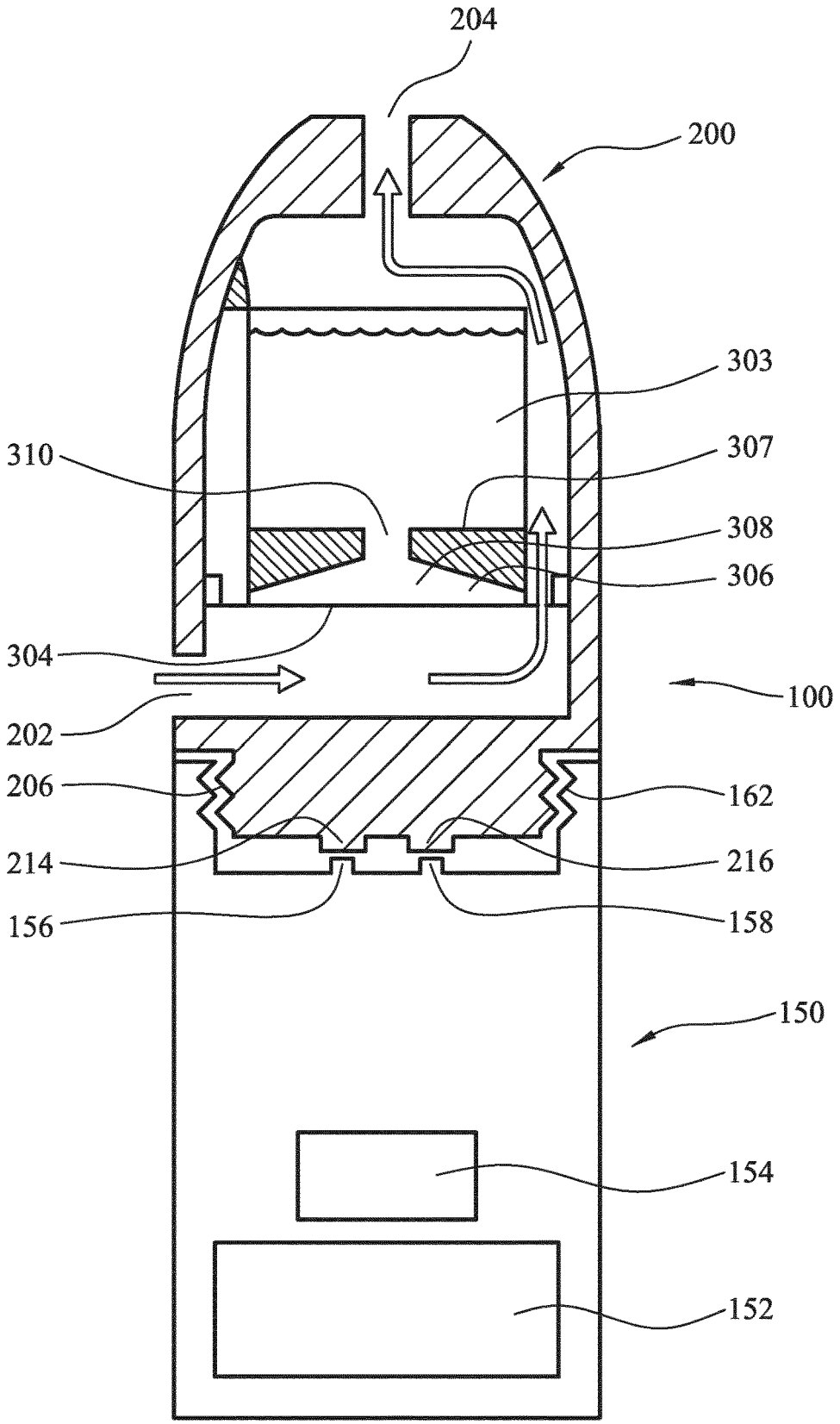
FIG. 1 shows a schematic, cross-sectional view of a first aerosol-generating system.

FIG. 1 shows a schematic, cross-sectional view of a first aerosol-generating system 100. The aerosol-generating system 100 comprises an aerosol-generating device 150 and a cartridge 200. In this example, the aerosol-generating system 100 is an electrically operated smoking system.

The aerosol-generating device 150 is portable and has a size comparable to a conventional cigar or cigarette. The device 150 comprises a battery 152, such as a lithium iron phosphate battery, and a controller 154 electrically connected to the battery 152. The device 150 also comprises two electrical contacts 156, 158 which are electrically connected to the battery 152. This electrical connection is a wired connection and is not shown in FIG. 1.

The cartridge 200 comprises first and second electrical contacts 214, 216, an air inlet 202, an air outlet 204, a reservoir 303 of liquid aerosol-forming substrate, a heating element 304, and a wall 307. The air inlet 202 is in fluid communication with the air outlet 204. The heater assembly 300 is positioned downstream of the air inlet 202 and upstream of the air outlet 204. The first and second electrical contacts 214, 216 are electrically connected to the heating element 304.

In this system 100, the liquid aerosol-forming substrate comprises around 74% by weight glycerine, 24% by weight propylene glycol, and 2% by weight nicotine, though any suitable substrate could be used. At atmospheric pressure, nicotine has a boiling point of around 247 degrees centigrade, glycerine has a boiling point of around 290 degrees centigrade and propylene glycol has a boing point of around 188 degrees centigrade. Thus, when initially heating this liquid aerosol-forming substrate to form an aerosol, some systems may undesirably vaporise a disproportionately large amount of propylene glycol (which has the lowest boiling point of the compounds forming the substrate). This may lead to a less desirable aerosol being delivered to the user, such as an aerosol comprising a smaller proportion of nicotine than desired. This may also undesirably change the relative proportions of the compounds in the substrate over a longer time period. The present invention may eliminate or at least reduce these undesirable effects.

The heating element 304 is an electrically resistive mesh heating element. In this example, the mesh is formed from stainless steel, though any suitable material could be used. The heating element 304 covers an open end of the reservoir 303 of liquid aerosol-forming substrate. The mesh heating element comprises apertures which are sufficiently small to prevent the liquid aerosol-forming substrate from leaking but sufficiently large to allow a suitable flow rate of vaporised liquid aerosol-forming substrate to pass through in use. In this example, the apertures are substantially square-shaped and have a side length of approximately 25 microns.

The cartridge 200 comprises a hot zone 306 and a feed zone 308. A first space adjacent to the heating element 304 and between the wall 307 and the heating element 304 forms the hot zone 306. A second space adjacent to the heating element 304 forms the feed zone 306. The reservoir 303 is in fluid communication with the feed zone 308 and the hot zone 306.

The wall 307 is formed from a non-porous, non-permeable material. In the example shown in FIG. 1, the wall 307 is formed from polyethylene terephthalate, though any suitable material could be used.

The wall 307 forms a boundary of a constricted passageway 310 which connects the reservoir 303 to the feed zone 308. In the example shown in FIG. 1, liquid aerosol-forming substrate from the reservoir 303 must pass through the constricted passageway 310, and then the feed zone 308, in order to reach the hot zone 306.

A surface of the wall 307 opposing the heating element 304 is not parallel with a heating surface of the heating element 304. The surface of the wall 307 opposing the heating element 304 tapers towards the heating element 304 in a direction from the feed zone 308 to the hot zone 306. Thus, minimum and average distances from the heating element 304 to the wall 307 through the hot zone 306 are less than minimum and average distances from the heating element 304 to wall 307 through the feed zone 308.

The hot zone 306 is more thermally insulated than the feed zone 308. For example, the hot zone 306 is more thermally insulated from the reservoir 303 than the feed zone 308. Thus, less heat will dissipate from the hot zone 306 into the reservoir 303 than from the feed zone 308 into the reservoir 303.

The wall 307 has a significantly lower thermal conductivity than the liquid aerosol-forming substrate. The wall 307 therefore effectively thermally insulates the hot zone 306 and the feed zone 308 from the reservoir 303 of liquid aerosol-forming substrate. Due to the taper of the wall 307, a portion of the wall 307 in contact with the feed zone 308 is thinner than a portion of the wall 307 in contact with the hot zone 306. Thus, the wall 307 thermally insulates the feed zone 308 from the reservoir 303 to a lesser extent than the wall thermally insulates the hot zone 306 from the reservoir 303.

In FIG. 1, the aerosol-generating device 150 is engaged with the cartridge 200. In this example, the cartridge 200 is engaged with the aerosol-generating device 150 via a screw thread 206 of the cartridge 200 mated with a corresponding screw thread 162 of the aerosol-generating device 150.

In use, a user puffs on the air outlet 204 of the cartridge 200. At the same time, the user presses a button (not shown) on the aerosol-generating device 150. Pressing this button sends a signal to the controller 154, which results in power being supplied from the battery 152 to the heating element 304 via the electrical contacts 156, 158 of the device and the electrical contacts 214, 216 of the cartridge. This causes a current to flow through the heating element 304, thereby resistively heating the heating element 304. In other examples, an air flow sensor, or pressure sensor, is located in the cartridge 200 and electrically connected to the controller 154. The air flow sensor, or pressure sensor, detects that a user is puffing on the air outlet 204 of the cartridge 200 and sends a signal to the controller 154 to provide power to the heating element 304. In these examples, there is therefore no need for the user to press a button to heat the heating element 304.

As the heating element 304 is heated, the feed zone 308 and the hot zone 306 increase in temperature. The hot zone 306 increases in temperature at a greater rate than the feed zone 308. Both the feed zone 308 and the hot zone 306 reach temperatures at which at least one compound in the liquid aerosol-forming substrate vaporises. As the heating element 304 is heated, an area of a higher temperature—the hot zone—and an area of a lower temperature—the feed zone—are created. Specifically, the hot zone 306 is heated to a temperature approximately 30 degrees Celsius higher than the feed zone 308. A number of factors contribute to this temperature difference.

In the example shown in FIG. 1, liquid aerosol-forming substrate in the reservoir 303 must flow through the constricted passageway 310, and then the feed zone 308, in order to reach the hot zone 306. So, as liquid aerosol-forming substrate in the hot zone 306 vaporises, liquid aerosol-forming substrate from the feed zone 308 replaces this liquid aerosol-forming substrate. Thus, pre-heated liquid aerosol-forming substrate replaces liquid aerosol-forming substrate vaporised from the hot zone 306. In contrast, as liquid aerosol-forming substrate in the feed zone 308 vaporises, liquid aerosol-forming substrate from the reservoir 303 replaces this liquid aerosol-forming substrate. So liquid aerosol-forming substrate replacing liquid aerosol-forming substrate vaporised from the feed zone 308 is not pre-heated, or is at least pre-heated to a lesser extent than the liquid aerosol-forming substrate replacing liquid aerosol-forming substrate vaporised from the hot zone 306. This increases the temperature difference between the hot zone 306 and the feed zone 308.

The creation of an area of a higher temperature and an area of a lower temperature may result in compounds of the liquid aerosol-forming substrate with higher boiling points and lower boiling points being vaporised simultaneously, in more preferable proportions, and at more preferable rates.

As the user puffs on the air outlet 204 of the cartridge 200, air is drawn into the air inlet 202. This air then travels across the heating element 304 and towards the air outlet 204. This flow of air entrains the vapour formed by the heating element 304 heating liquid aerosol-forming substrate in the hot zone 306 and the feed zone 308. This entrained vapour then cools and condenses to form an aerosol. This aerosol is then delivered to the user via the air outlet 204. In FIG. 1, arrows have been used to indicate the direction of air flow as a user puffs on the air outlet 204.

Figure 2:
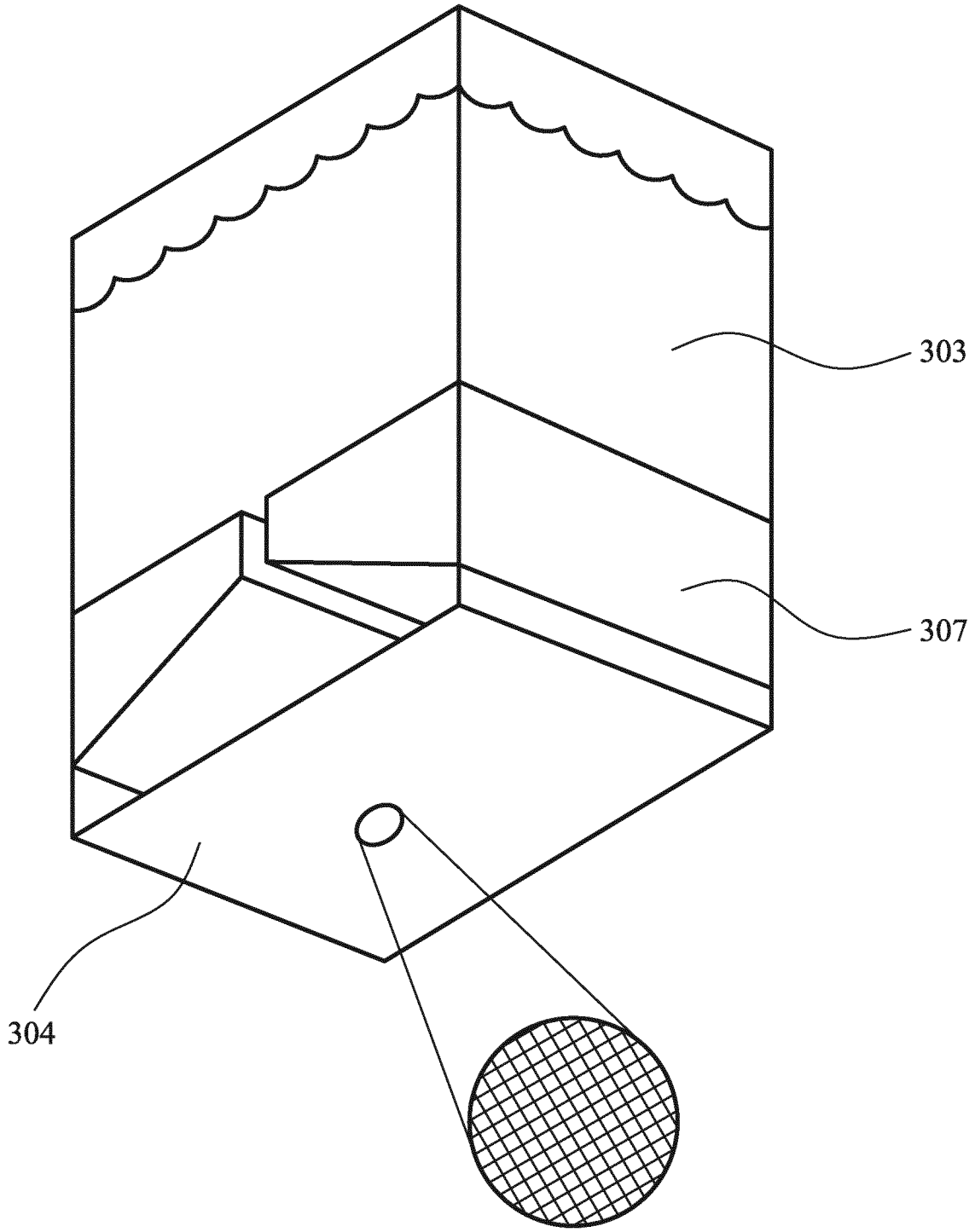
FIG. 2 shows a schematic, perspective view of a portion of a cartridge of the first aerosol-generating system.

FIG. 2 shows a schematic, perspective view of a portion of the cartridge. Specifically, FIG. 2 shows the reservoir 303, the heating element 304, and the wall 307. In FIG. 2, an enlarged view of a portion of the heating element 304 is shown. This shows the structure of the mesh heating element.

Figure 3:
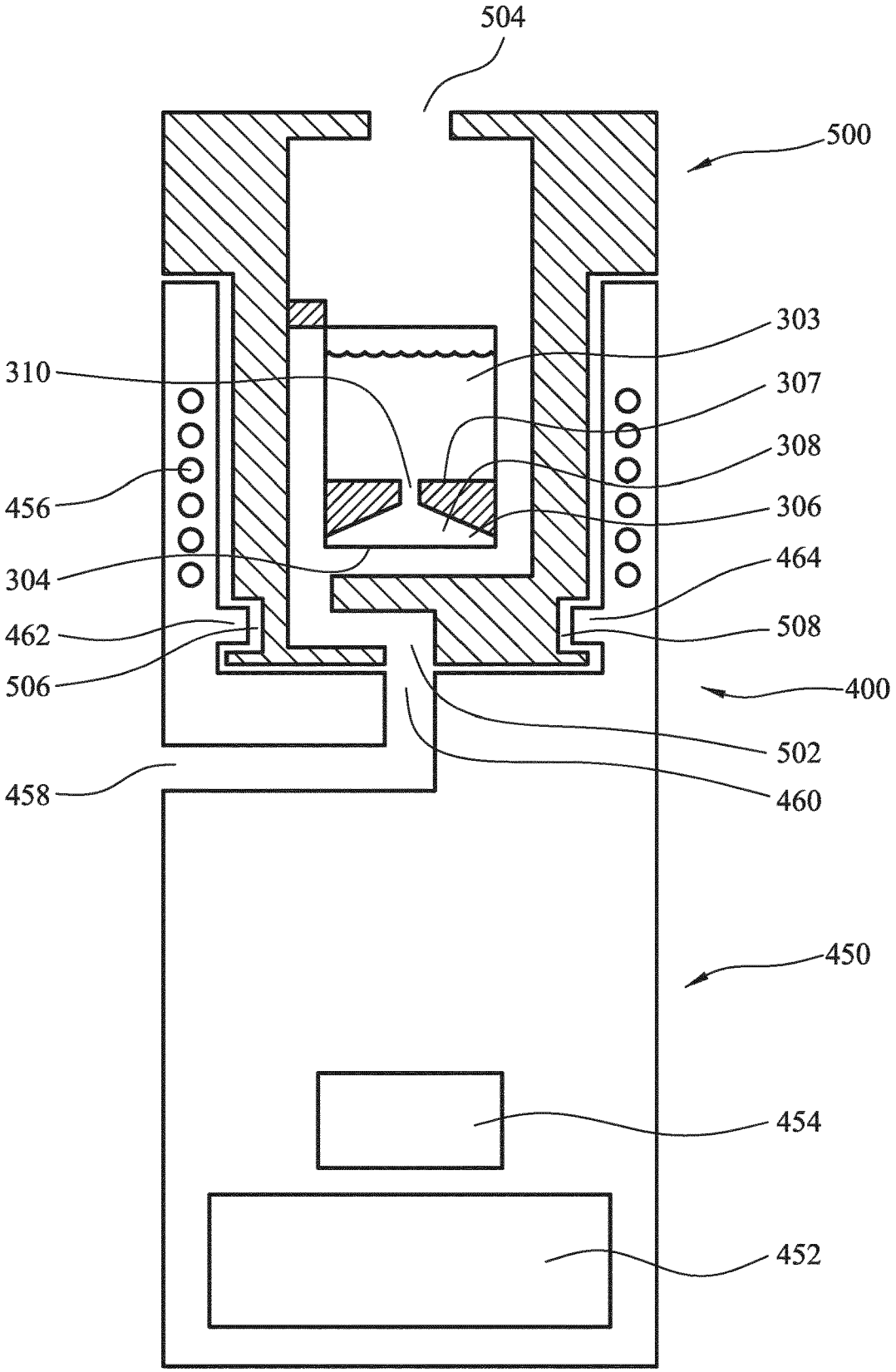
FIG. 3 shows a schematic, cross-sectional view of a second aerosol-generating system.

FIG. 3 shows a schematic, cross-sectional view of a second aerosol-generating system 400. The aerosol-generating system 400 comprises an aerosol-generating device 450 and a cartridge 500. In this example, the aerosol-generating system 400 is an electrically operated smoking system.

The aerosol-generating device 450 is portable and has a size comparable to a conventional cigar or cigarette. The device 450 comprises a battery 452, such as a lithium iron phosphate battery, and a controller 454 electrically connected to the battery 452. The device 450 also comprises an induction coil 456 electrically connected to the battery 452. The device 450 also comprises an air inlet 458 and an air outlet 460 in fluid communication with the air inlet 458.

The cartridge 500 comprises a reservoir 303 of liquid aerosol-forming substrate, a heating element 304, a wall 307, a hot zone 306, a feed zone 308, and a constricted passageway 310. The reservoir 303 of liquid aerosol-forming substrate, the heating element, 304, the wall 307, the hot zone 306, the feed zone 308, and the constricted passageway 310 are all identical to those shown and described in relation to the first example shown in FIG. 1. However, the heating element 304 in the example shown in FIG. 3 is configured to be inductively heated.

The cartridge 500 comprises an air inlet 502 and an air outlet 504. The air inlet 502 is in fluid communication with the air outlet 504. The heating element 304 is positioned downstream of the air inlet 502 and upstream of the air outlet 504. When the cartridge 500 is engaged with the aerosol-generating device 450, as shown in FIG. 3, the air outlet 460 of the device 450 is adjacent to the air inlet 502 of the cartridge 500. Thus, in use, when a user puffs on the air outlet 504 of the cartridge 500, air flows through the air inlet 458 of the device 450, then through the air outlet 460 of the device 450, then through the air inlet 502 of the cartridge 500, then past the heating element 304, then through the air outlet 504 of the cartridge 500.

In FIG. 3, the cartridge 500 is engaged with the aerosol-generating device 450. In this example, the cartridge 500 is engaged with the aerosol-generating device 450 via apertures 506, 508 which form a snap-fit connection with corresponding protrusions 462, 464 on the aerosol-generating device 450.

In the example shown in FIG. 3, the heating element 304 is configured to be inductively, rather than resistively, heated. Thus, the stainless steel material of the heating element 304 acts as a susceptor material. Notably, however, any suitable susceptor material could be used.

In use, a user puffs on the air outlet 504 of the cartridge 500. At the same time, the user presses a button (not shown) on the aerosol-generating device 450. Pressing this button sends a signal to the controller 454, which results in the battery 452 supplying a high frequency electrical current to the induction coil 456. This causes the induction coil 456 to create a fluctuating or oscillating electromagnetic field. The heating element 304 is positioned within this field. Thus, this fluctuating electromagnetic field generates eddy currents and hysteresis losses in the heating element 304. The heating element 304 is therefore inductively heated. In other examples, an air flow sensor, or pressure sensor, is located in the device 450 and electrically connected to the controller 454. The air flow sensor, or pressure sensor, detects that a user is puffing on the air outlet 504 of the cartridge 500 and sends a signal to the controller 454 to supply the high frequency electrical current to the induction coil 456, thereby heating the heating element 304. In these examples, there is therefore no need for the user to press a button to heat the first heating element 604 and the second heating element 605.

As the heating element 304 is heated, the feed zone 308 and the hot zone 306 increase in temperature. The hot zone 306 increases in temperature at a greater rate than the feed zone 308. Both the feed zone 308 and the hot zone 306 reach temperatures at which at least one compound in the liquid aerosol-forming substrate vaporises. As the heating element 304 is heated, an area of a higher temperature—the hot zone—and an area of a lower temperature—the feed zone—are created. Specifically, the hot zone 306 is heated to a temperature approximately 30 degrees Celsius higher than the feed zone 308. A number of factors contribute to this temperature difference.

Due to the taper of the wall 307, the hot zone 306 is, on average, closer to the heating element 304 than the feed zone 308.

The hot zone 306 is more thermally insulated than the feed zone 308. For example, the hot zone 306 is more thermally insulated from the reservoir 303 than the feed zone 308. Thus, less heat will dissipate from the hot zone 306 into the reservoir 303 than from the feed zone 308 into the reservoir 303.

In the example shown in FIG. 3, like in the example shown in FIG. 1, liquid aerosol-forming substrate in the reservoir 303 must flow through the constricted passageway 310, and then the feed zone 308, in order to reach the hot zone 306. So, as liquid aerosol-forming substrate in the hot zone 306 vaporises, liquid aerosol-forming substrate from the feed zone 308 replaces this liquid aerosol-forming substrate. Thus, pre-heated liquid aerosol-forming substrate replaces liquid aerosol-forming substrate vaporised from the hot zone 306. In contrast, as liquid aerosol-forming substrate in the feed zone 308 vaporises, liquid aerosol-forming substrate from the reservoir 303 replaces this liquid aerosol-forming substrate. So liquid aerosol-forming substrate replacing liquid aerosol-forming substrate vaporised from the feed zone 308 is not pre-heated, or is at least pre-heated to a lesser extent than the liquid aerosol-forming substrate replacing liquid aerosol-forming substrate vaporised from the hot zone 306. This increases the temperature difference between the hot zone 306 and the feed zone 308.

The creation of an area of a higher temperature and an area of a lower temperature may result in compounds of the liquid aerosol-forming substrate with higher boiling points and lower boiling points being vaporised simultaneously, in more preferable proportions, and at more preferable rates.

As the user puffs on the air outlet 504 of the cartridge 500, air is drawn into the air inlet 458 of the device 450, then through the air outlet 460 of the device 450, then through the air inlet 502 of the cartridge 500. This air then travels past the heating element 304 and towards the air outlet 504. This flow of air entrains the vapour formed by heating of the liquid aerosol-forming substrate by the heating element 304. This entrained vapour then cools and condenses to form an aerosol. This aerosol is then delivered to the user via the air outlet 504.

Figure 4:
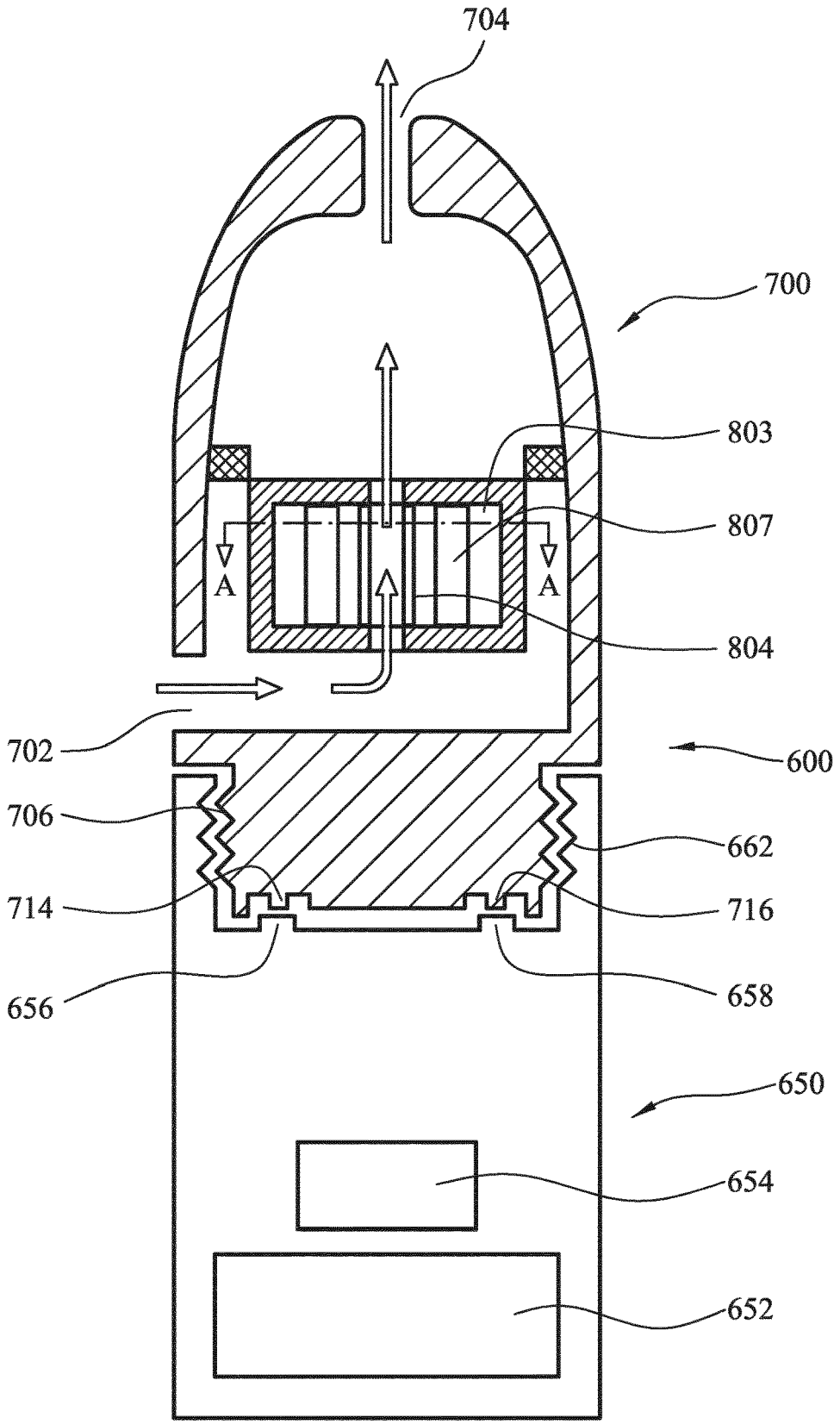
FIG. 4 shows a schematic, cross-sectional view of a third aerosol-generating system.

FIG. 4 shows a schematic, cross-sectional view of a third aerosol-generating system 600. The aerosol-generating system 600 comprises an aerosol-generating device 650 and a cartridge 700. In this example, the aerosol-generating system 600 is an electrically operated smoking system.

The aerosol-generating device 650 is portable and has a size comparable to a conventional cigar or cigarette. The device 650 comprises a battery 652, such as a lithium iron phosphate battery, and a controller 654 electrically connected to the battery 652. The device 650 also comprises two electrical contacts 656, 658 which are electrically connected to the battery 652. This electrical connection is a wired connection and is not shown in FIG. 4.

The cartridge 700 comprises first and second electrical contacts 714, 716, an air inlet 702, an air outlet 704, a reservoir 803 of liquid aerosol-forming substrate, a heating element 804, and a wall 807. The air inlet 702 is in fluid communication with the air outlet 704. The heating element 804 is positioned downstream of the air inlet 702 and upstream of the air outlet 704. The first and second electrical contacts 714, 716 are electrically connected to the heating element 804.

In this system 600, the liquid aerosol-forming substrate comprises around 98% by weight glycerine and 2% by weight nicotine, though any suitable substrate could be used. At atmospheric pressure, nicotine has a boiling point of around 247 degrees centigrade and glycerine has a boiling point of around 290 degrees centigrade. Thus, when initially heating this liquid aerosol-forming substrate to form an aerosol, some systems may undesirably vaporise a disproportionately large amount of nicotine (which has the lowest boiling point of the compounds forming the substrate). This may lead to a less desirable aerosol being delivered to the user. This may also undesirably change the relative proportions of the compounds in the substrate over a longer time period. The present invention may eliminate or at least reduce these undesirable effects.

The heating element 804 is an electrically resistive mesh heating element. In this example, the mesh is formed from stainless steel, though any suitable material could be used. The heating element 804 substantially entirely circumscribes an air flow path from the air inlet 702 to the air outlet 704. Specifically, the heating element 804 circumscribes around 355 degrees of an air flow path. The mesh heating element comprises apertures which are sufficiently small to prevent the liquid aerosol-forming substrate from leaking but sufficiently large to allow a suitable flow rate of vaporised liquid aerosol-forming substrate to pass through in use. In this example, the apertures are substantially square-shaped and have a side length of approximately 25 microns.

The cartridge 700 comprises multiple hot zones and multiple feed zones. These zones will now be described in more detail with reference to FIG. 5.

Figure 5:
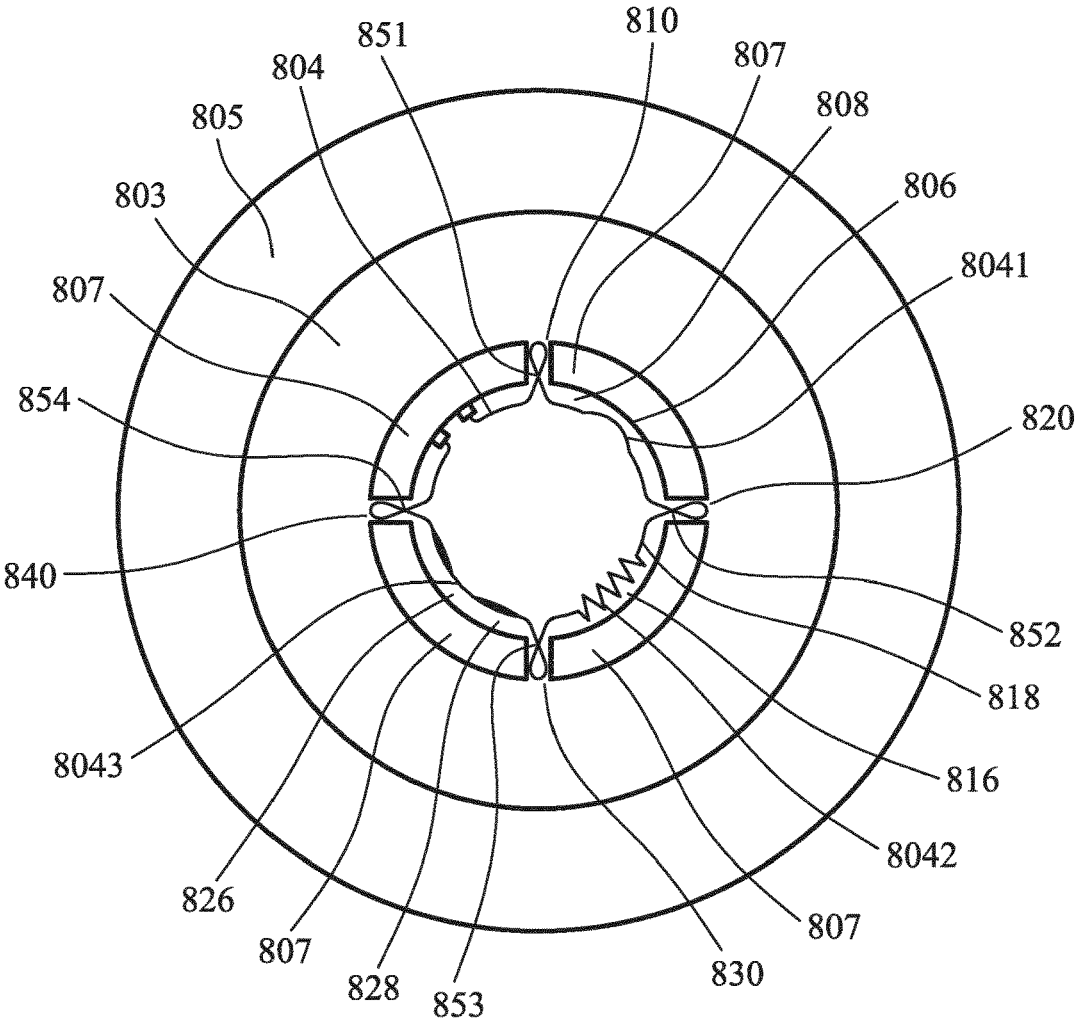
FIG. 5 shows a schematic, cross-sectional view of a portion of a cartridge of the third aerosol-generating system.

FIG. 5 is a schematic, cross-sectional view of a portion of the cartridge of the third aerosol-generating system. The cross-sectional view shown in FIG. 5 is a perpendicular view to that shown in FIG. 4. Specifically, the view shown in FIG. 5 is a cross-sectional view indicated by the line A-A in FIG. 4.

FIG. 5 shows a reservoir 803 of liquid aerosol-forming substrate bounded by a container 805. FIG. 5 also shows the heating element 804, a first hot zone 806, a second hot zone 816, a third hot zone 826, a first feed zone 808, a second feed zone 818, a third feed zone 828, a fourth feed zone 838, and a wall 807 which forms the boundaries of a first constricted passageway 810, a second constricted passageway 820, a third constricted passageway 830, and a fourth constricted passageway 840. The reservoir 803 of liquid aerosol-forming substrate is in fluid communication with all of the feed zones and hot zones.

In use, liquid aerosol-forming substrate may flow from the reservoir 803, through the first constricted passageway 810, then through the first feed zone 808, then to the first hot zone 806. The first feed zone 808 is located adjacent to the heating element 804 and between the heating element 804 and the wall 807. The first hot zone 806 is located adjacent to the heating element 804 and between the heating element 804 and the wall 804. The first feed zone 808 is adjacent to the first hot zone 806. A portion 8041 of the heating element 804 adjacent to the first feed zone 808 and the first hot zone 806 is curved such that a minimum distance from the heating element 804 to wall 807 through the first hot zone 806 is less than a minimum distance from the heating element 804 to the wall 807 through the first feed zone 808. This may result in the first hot zone 806 being heated to a higher temperature than the first feed zone 808.

In use, liquid aerosol-forming substrate may flow from the reservoir 803, through the second constricted passageway 820, then through the second feed zone 818, then to the second hot zone 816. The second feed zone 818 is located adjacent to the heating element 804 and between the heating element 804 and the wall 807. The second hot zone 816 is located adjacent to the heating element 804 and between the heating element 804 and the wall 804. The second feed zone 818 is adjacent to the second hot zone 816. A portion 8042 of the heating element 804 adjacent to the second hot zone 816 comprises a number of undulations. These undulations increase a volume and surface area of the heating element 804 in close proximity to the second hot zone 816. This may result in the second hot zone 816 being heated to a higher temperature than the second feed zone 818.

In use, liquid aerosol-forming substrate may flow from the reservoir 803, through the third constricted passageway 830, then through the third feed zone 828, then to the third hot zone 826. The third feed zone 828 is located adjacent to the heating element 804 and between the heating element 804 and the wall 807. The third hot zone 826 is located adjacent to the heating element 804 and between the heating element 804 and the wall 804. The third feed zone 828 is adjacent to the third hot zone 826. A portion 8043 of the heating element 804 adjacent to the third feed zone 828 and the third hot zone 826 varies in thickness. Specifically, the thickness varies such that a minimum thickness of the heating element 804 adjacent to the third hot zone 826 is around 50% less than a minimum thickness of the heating element 804 adjacent to the third feed zone 828. The thinner portion of the heating element 804 may have an increased electrical resistance and may therefore be resistively heated to a higher temperature in use. This may result in the third hot zone 826 being heated to a higher temperature than the third feed zone 828.

The wall 807 of the cartridge forms four supports for the heating element 804. A section 851, 852, 853, 854 of the heating element 804 contacts each support.

Each section 851, 852, 853, 854 of the heating element 804 contacting a support is folded so as to contact itself. Each folded section 851, 852, 853, 854 therefore has a lower electrical resistance, and is heated to a lower temperature, than if each section 851, 852, 853, 854 were not folded so as to contact itself. Thus, each section 851, 852, 853, 854 of the heating element 804 dissipates less heat into the reservoir 803 of liquid aerosol-forming substrate.

The wall 807 is formed from a porous material. In the example shown in FIG. 5, the wall 807 is formed from a porous ceramic material, specifically alumina, though any suitable material could be used. Thus, liquid aerosol-forming substrate is able to pass from the reservoir 803, through the wall 807, and into one of the feed zones 808, 818, 828 or hot zones 806, 816, 826. This may help to prevent any of the feed zones 808, 818, 828 or hot zones 806, 816, 826 from becoming dry as liquid aerosol-forming substrate is vaporised. The porosity, and pore size distribution, of the wall 807 is selected so as to allow an appropriate flow rate of liquid from the reservoir 803 to flow through the wall 807 in use. In the example shown in FIG. 5, the porosity of the wall 807 is approximately 50%. As used here, the term "porosity" refers to a measure, expressed as a percentage, of the volume of accessible pores, or empty space, of the wall divided by the total volume of the wall. The porosity here was measured by mercury intrusion porosimetry. Pores of different shapes and sizes may be present in the wall 807. In the example shown in FIG. 5, the pores in the wall 807 have an average pore size of around 30 microns. The pore size distribution is defined as the statistical distribution of the diameter of the largest sphere that can fit inside a pore at a given point. As used here, term "average pore size" refers to a mean of this pore size distribution. The pore sizes referred to here were obtained using mercury intrusion porosimetry.

Despite the wall 807 being porous, a substantial proportion of liquid aerosol-forming substrate reaching the hot zones 806, 816, 826 from the reservoir 803 travels through the feed zones 808, 818, 828. Thus, much of the liquid aerosol-forming substrate reaching the hot zones 806, 816, 826 is pre-heated. This may help to increase, or maintain, a temperature difference of the liquid aerosol-forming substrate in the hot zones 806, 816, 826 compared with the feed zones 808, 818, 828.

The wall 807 has a significantly lower thermal conductivity than the liquid aerosol-forming substrate. The wall 807 therefore effectively thermally insulates the hot zones 806, 816, 826 and the feed zones 808, 818, 828 from the reservoir 803 of liquid aerosol-forming substrate.

Figure 6:
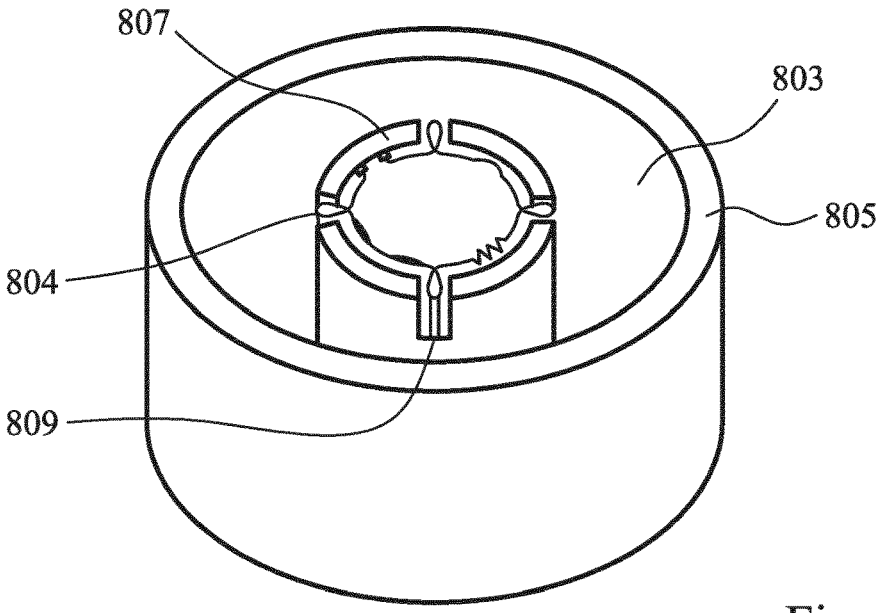
FIG. 6 shows a schematic, perspective view of a portion of a cartridge of the third aerosol-generating system.

FIG. 6 shows a schematic, perspective view of the portion of the cartridge shown in FIG. 5. FIG. 6 shows the reservoir 803 of liquid aerosol-forming substrate, the container 805, the heating element 804, the wall 807, and one of the aforementioned supports 809.

Referring back to FIG. 4, the aerosol-generating device 650 is engaged with the cartridge 700. In this example, the cartridge 700 is engaged with the aerosol-generating device 650 via a screw thread 706 of the cartridge 700 mated with a corresponding screw thread 662 of the aerosol-generating device 650.

In use, a user puffs on the air outlet 704 of the cartridge 700. At the same time, the user presses a button (not shown) on the aerosol-generating device 650. Pressing this button sends a signal to the controller 654, which results in power being supplied from the battery 652 to the heating element 804 via the electrical contacts 656, 658 of the device and the electrical contacts 714, 716 of the cartridge. This causes a current to flow through the heating element 804, thereby resistively heating the heating element 804. In other examples, an air flow sensor, or pressure sensor, is located in the cartridge 700 and electrically connected to the controller 654. The air flow sensor, or pressure sensor, detects that a user is puffing on the air outlet 704 of the cartridge 700 and sends a signal to the controller 654 to provide power to the heating element 804. In these examples, there is therefore no need for the user to press a button to heat the heating element 804.

As the heating element 804 is heated, the feed zones 808, 818, 828 and the hot zones 806, 816, 826 increase in temperature. All of the feed zones 808, 818, 828 and the hot zones 806, 816, 826 reach temperatures at which at least one compound in the liquid aerosol-forming substrate vaporises. As the heating element 804 is heated, areas of higher temperature—the hot zones—and areas of lower temperature—the feed zones—are created.

The creation of an areas of higher temperatures and areas of lower temperatures may result in compounds of the liquid aerosol-forming substrate with higher boiling points and lower boiling points to be vaporised simultaneously, in more preferable proportions, and at more preferable rates.

As the user puffs on the air outlet 704 of the cartridge 700, air is drawn into the air inlet 702. This air then travels across the heating element 804 and towards the air outlet 704. This flow of air entrains the vapour formed by the heating element 804 heating liquid aerosol-forming substrate. This entrained vapour then cools and condenses to form an aerosol. This aerosol is then delivered to the user via the air outlet 704. In FIG. 1, arrows indicate the direction of air flow as a user puffs on the air outlet 704.

The cartridges described herein achieve creation of areas of higher and areas of lower temperature in the liquid aerosol-forming substrate. Advantageously, this may improve control of the vaporisation of the different compounds of the liquid aerosol-forming substrate. This may encourage liquid aerosol-forming substrate compounds with higher boiling points and lower boiling points to be vaporised simultaneously, in more preferable proportions, and at more preferable rates. This may allow generation of an aerosol with a more desirable composition, and more consistent generation of an aerosol with a desirable composition.

For the purpose of the present description and appended claims, except where otherwise indicated, all numbers expressing amounts, quantities, percentages, and so forth, are to be understood as being modified in all instances by the term "about". Also, all ranges include the maximum and minimum points disclosed and include any intermediate ranges therein, which may or may not be specifically enumerated herein. In this context, therefore, a number A is understood as A ±10% of A. Within this context, a number A may be considered to include numerical values that are within general standard error for the measurement of the property that the number A modifies. The number A, in some instances as used in the appended claims, may deviate by the percentages enumerated above provided that the amount by which A deviates does not materially affect the basic and novel characteristic(s) of the claimed invention. Also, all ranges include the maximum and minimum points disclosed and include any intermediate ranges therein, which may or may not be specifically enumerated herein.

The invention claimed is:

1. A cartridge for an aerosol-generating system, the cartridge comprising:

a reservoir configured for liquid aerosol-forming substrate;

a heating element configured to heat the liquid aerosol-forming substrate from the reservoir; and a wall, wherein:

a first space adjacent to the heating element and between the wall and the heating element forms a hot zone, a second space adjacent to the heating element forms a feed zone, the reservoir is in fluid communication with the feed zone and the hot zone, at least a portion of the wall is positioned between the hot zone and the reservoir, the wall is in contact with the hot zone and the reservoir, and a portion of the wall in contact with the feed zone is thinner than a portion of the wall in contact with the hot zone.

2. The cartridge according to claim 1, wherein the wall thermally insulates the feed zone from the reservoir to a lesser extent than the wall thermally insulates the hot zone from the reservoir.

3. The cartridge according to claim 1, further comprising an air inlet and an air outlet, an air flow path being defined between the air inlet and the air outlet.

4. The cartridge according to claim 1, wherein a shortest distance between the wall and the heating element through the hot zone is less than a shortest distance between the wall and the heating element through the feed zone.

5. The cartridge according to claim 1, wherein at least a portion of the wall is positioned between the feed zone and the reservoir.

6. The cartridge according to claim 1, wherein the feed zone is adjacent to an opening in the wall.

7. The cartridge according to claim 1, further comprising a constricted passageway that connects the reservoir to the feed zone.

8. The cartridge according to claim 1, wherein the second space is between the wall and the heating element.

9. An aerosol-generating system comprising a cartridge according to claim 1.

* * * * *